US007156754B2

(12) United States Patent
Dijkgraaf et al.

(10) Patent No.: US 7,156,754 B2
(45) Date of Patent: Jan. 2, 2007

(54) LIGHT-EMITTING GOLF BALL

(75) Inventors: Ruud Dijkgraaf, Ridderkerk (NL); Ger Moot, Ridderkerk (NL)

(73) Assignee: Golf Art Innovation N.V. (AN)

( * ) Notice: Subject to any disclaimer, the term of this patent is extended or adjusted under 35 U.S.C. 154(b) by 165 days.

(21) Appl. No.: 10/414,584

(22) Filed: Apr. 16, 2003

(65) Prior Publication Data

US 2003/0236136 A1 Dec. 25, 2003

Related U.S. Application Data

(63) Continuation-in-part of application No. 09/527,779, filed on Mar. 17, 2000, now abandoned.

(30) Foreign Application Priority Data

Mar. 17, 1999 (NL) ..... 1011583

(51) Int. Cl.
*A63B 37/08* (2006.01)

(52) U.S. Cl. ..... 473/354; 473/353

(58) Field of Classification Search ..... 473/351, 473/354, 353

See application file for complete search history.

(56) References Cited

U.S. PATENT DOCUMENTS

| | | | | |
|---|---|---|---|---|
| 716,645 | A | 12/1902 | Ransom | |
| 3,351,347 | A | 11/1967 | Smith | |
| 3,539,794 | A | 11/1970 | McKay et al. | |
| 3,800,132 | A | 3/1974 | Postal | |
| 4,015,111 | A | 3/1977 | Spector | |
| 4,064,428 | A | 12/1977 | Van Zandt | |
| 4,479,649 | A | 10/1984 | Newcomb et al. | |
| 4,695,055 | A * | 9/1987 | Newcomb et al. | 473/200 |
| 4,878,674 | A * | 11/1989 | Newcomb et al. | 473/200 |
| 4,957,297 | A * | 9/1990 | Newcomb et al. | 473/409 |
| 5,552,968 | A | 9/1996 | Ladyjensky | |
| 5,562,290 | A | 10/1996 | Wei | |
| 5,882,239 | A | 3/1999 | Trichak | |
| 5,980,395 | A | 11/1999 | Tsunoda et al. | |
| 6,136,125 | A | 10/2000 | Ihara et al. | |
| 2003/0176240 | A1 * | 9/2003 | Redwine et al. | 473/354 |

FOREIGN PATENT DOCUMENTS

| | | |
|---|---|---|
| FR | 2 487 683 | 2/1982 |
| FR | 2 519 558 | 7/1983 |
| JP | 60-222071 | 11/1985 |

OTHER PUBLICATIONS

Accamando, Emily, "Force of a Golf Club on a Golf Ball", *The Physics Factbook*, http://hypertextbook.com/facts/2001/Emily.

Farrally, M.R., et al., *Science and Golf III*, Illinois: Human Kinetics, 1999, 407-413.

* cited by examiner

*Primary Examiner*—Raeann Gorden

(74) *Attorney, Agent, or Firm*—Jeffrey D. Peterson; Michael Best & Friedrich LLP

(57) ABSTRACT

A light-emitting golf ball for use in the dark, comprises a spherical body made from a transparent material with an outer casing, and light-emitting means containing chemiluminescent components made from a chemiluminescent material, which components emit light once they have been mixed with one another. The spherical body is provided with a cavity in which there are compartments which are separated from one another by a partition element. One of the chemiluminescent components is accommodated in each compartment. The partition element is of frangible design, in such a manner that an impact load exerted on the outer casing causes the partition element to break, after which the chemiluminescent components can mix with one another.

19 Claims, 7 Drawing Sheets

LIGHT-EMITTING GOLF BALL

CROSS-REFERENCE TO RELATED APPLICATIONS

This is a continuation-in-part of U.S. patent application Ser. No. 09/527,779 filed Mar. 17, 2000 now abandoned, which was a continuation application of NL 1011583, filed Mar. 17, 1999.

FIELD OF THE INVENTION

The invention relates to a light-emitting golf ball for use in the dark, comprising a spherical body made from a transparent material with an outer casing; and light-emitting means containing a chemiluminescent components made from a chemiluminescent material, which components emit light once they have been mixed with one another.

BACKGROUND OF THE INVENTION

A golf ball of this nature is known from U.S. Pat. No. 4,878,674. The golf ball described in this document comprises a solid spherical body made from a translucent material in which a diametrically extending continuous hole is formed. A light stick containing chemiluminescent material can be arranged in the hole. The light stick has two chambers which are separated from one another by a partition and contain chemical components of the chemiluminescent material. The light stick has to be activated before it is fitted. It is activated by bending the light stick manually until the partition breaks, after which the components can mix with one another. This results in a chemical reaction during which light is emitted, which then shines out through the golf ball.

A drawback of this known light-emitting golf ball that it is difficult to use. Positioning the light stick in the hole after activation causes problems. The light stick is small and flexible and, moreover, has to find a frictional fit in the recess. After the light stick has been fitted, it still has to be centered in the hole, for example with the aid of a golf tee. The light sticks are stored separately from the golf ball, and consequently there is a risk of the sticks breaking prematurely. The properties of the golf ball are not ideal. The golf ball is unstable owing to the lack of symmetry and the fact that the outer casing is not closed. During use, the light stick can slide out of the hole if the golf ball is hit very hard.

SUMMARY OF THE INVENTION

The object of the present invention is to overcome the above drawbacks and, in particular, to provide a light-emitting golf ball which is simple to activate and has good properties when hit and during flight, which golf ball can be used even for official competitions.

According to the invention, this object is achieved by means of a light-emitting golf ball according to claim 1. The golf ball comprises a spherical body which is provided with a cavity in the centre. The cavity is divided into compartments which are separated and sealed from one another by a partition element. The compartments contain components of a chemiluminescent material. The partition element is of frangible design. According to the invention, the light-emitting agents are activated by an impact load which is exerted on the outer casing. The impact load causes the partition element which is arranged in the cavity of the body to break open. As a result, the components come into open communication with one another, and the components of the chemiluminescent material can mix and emit light. The result is a golf ball with light-emitting means which are accommodated in the core and are automatically activated by a first impact load exerted on the outer casing of the golf ball. This impact load is derived, for example, from the ball being hit with a golf club. After the chemical reaction has finished, the golf ball can continue to be used as a conventional golf ball. The golf ball may be of symmetrical design with a preferably closed outer casing. Consequently, it is possible to give the golf ball properties when hit and in flight which are desired of conventional golf balls. In particular, the golf ball is designed in such a manner that it complies with the requirements of the United States Golf Association.

Advantageously, the partition element is designed in such a manner that an impact load of at least 300 N, and more particularly of 1000 N, has to be exerted on the outer casing before the partition element breaks. An impact load of this nature occurs in particular when the golf ball is driven, and can also be achieved by throwing the golf ball forcibly onto hard ground. This lower limit for breaking the partition element ensures that the light means are not inadvertently activated prematurely, for example during transport.

Preferred embodiments of the invention are defined in the subclaims.

BRIEF DESCRIPTION OF THE DRAWINGS

The invention will be explained in more detail with reference to the appended drawing, in which.

DESCRIPTION OF THE PREFERRED EMBODIMENTS

Figure 1:
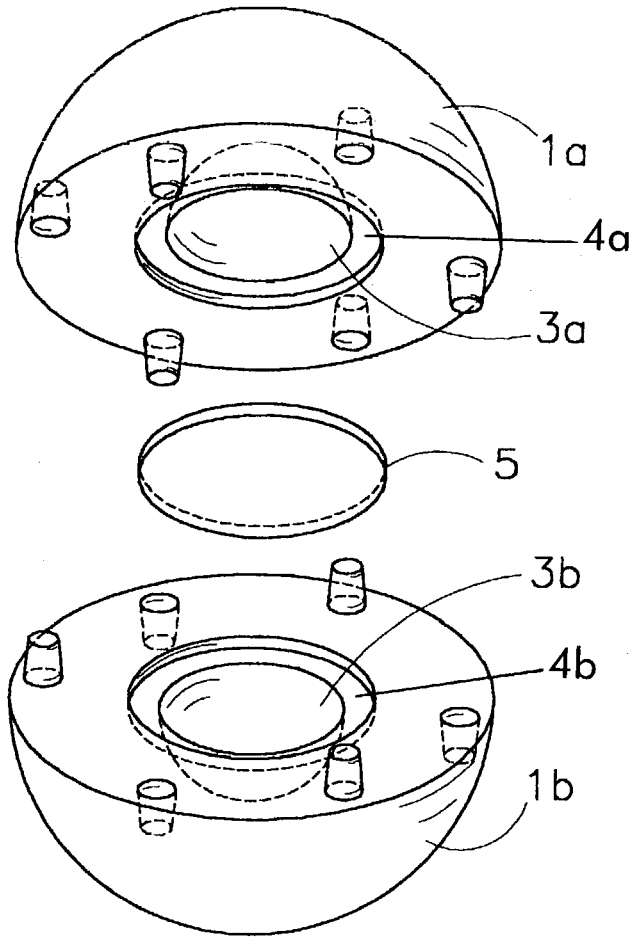
FIG. 1 shows a perspective view, in exploded form, of a first embodiment of a golf ball according to the invention, without outer shell.
Figure 2:
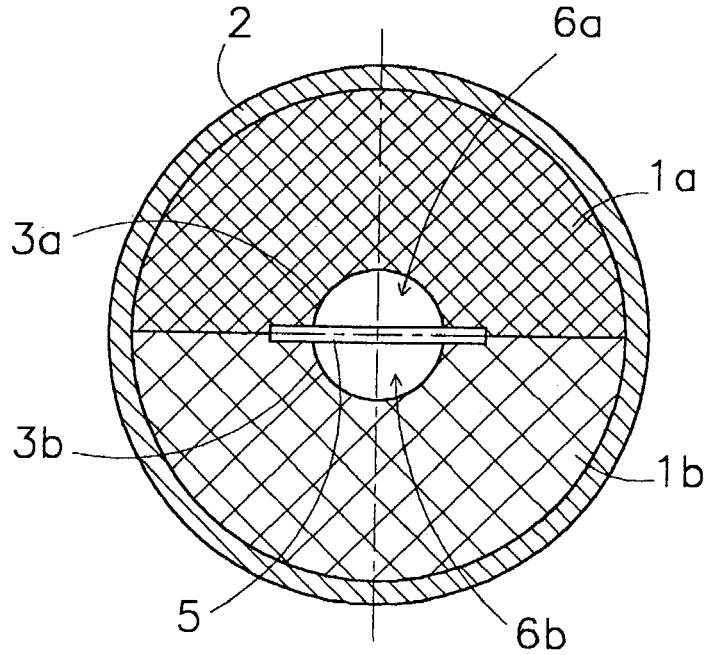
FIG. 2 shows a cross-sectional view of the golf ball from FIG. 1, with outer shell.

The golf ball in FIGS. 1 and 2 comprises a spherical body made from a transparent plastic material. The spherical body is substantially composed of a flexible core body 1 which is surrounded by a relatively hard outer shell 2. The core body is made, for example, from a transparent polyurethane. The outer shell 2 is made, for example, from transparent ionomer resin, such as Surlyn™. As can be seen clearly from FIG. 1, the core body 1 is composed of two shell halves 1*a*, 1*b*. The shell halves 1*a*, 1*b* are provided with complementary projections and recesses for joining the shell halves 1*a*, 1*b* securely together in combination with a suitable adhesive. The core body 1 is provided with a cavity 3 which is closed on the outside, each shell half 1*a*, 1*b* comprising a cavity part 3*a*, 3*b*. The cavity preferably is shaped symmetrical around the mass centre of the golf ball, and is constructed, for example, spherical, tetrahedrical or octahedronic. In the cavity 3, there is a partition 5 which divides the cavity 3 into two compartments 6*a*, 6*b* which are separated from one another. The two compartments 6*a*, 6*b* each contain one chemical component of a chemiluminescent material. The partition 5 is designed in the form of a disc and bears in a sealed manner against the wall of the cavity 3 all the way around and fits in receiving shelves 4*a* and 4*b* of shell halves 1*a* and 1*b*. The partition 5 is of fragile design and breaks if a specific impact load is exerted on the relatively hard outer shell 2. For this purpose, the partition 5 consists, for example, of thin and/or weakened glass or plastic.

Figure 3:
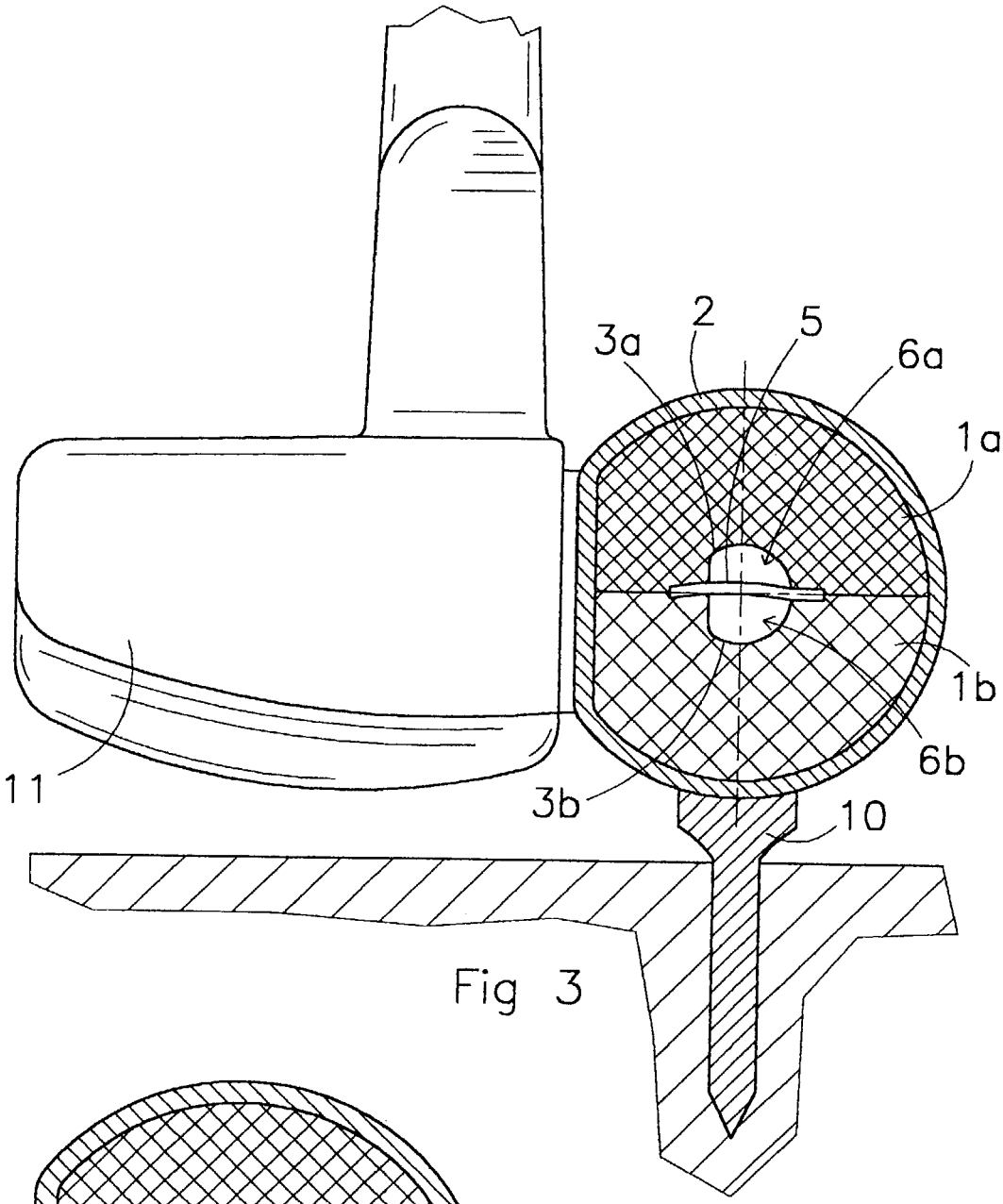
FIG. 3 shows a view corresponding to FIG. 2, with the golf ball in a first state of deformation.
Figure 4:
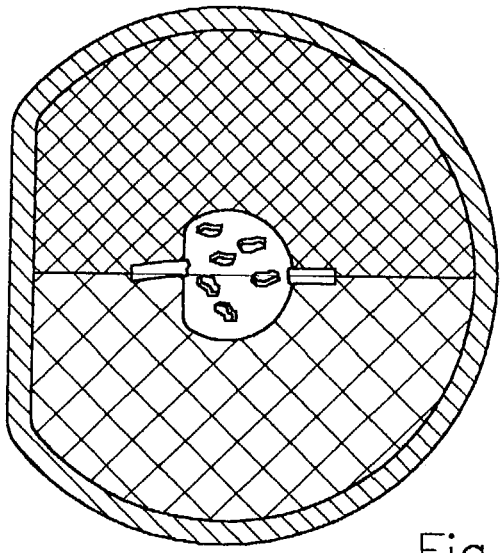
FIG. 4 shows a view in accordance with FIG. 2, with the golf ball in a second state of deformation.
Figure 5:
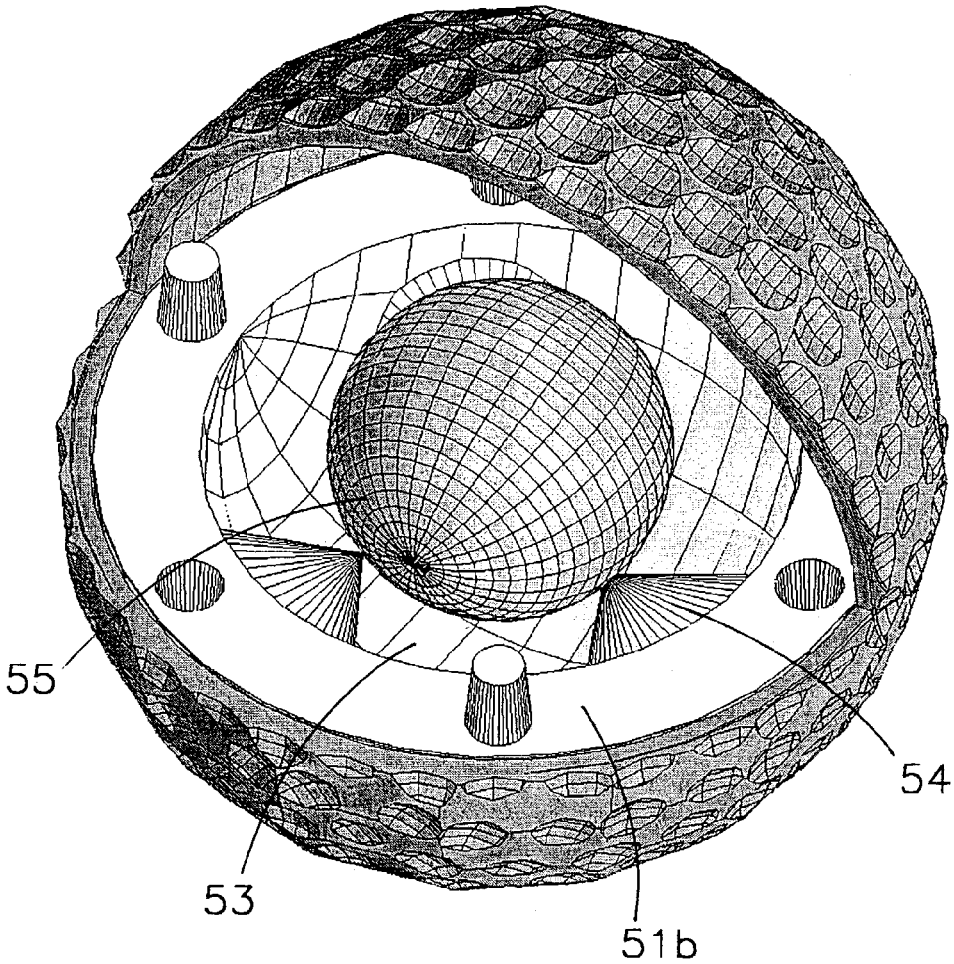
FIG. 5 shows a diagrammatic, perspective view of a second embodiment of a golf ball according to the invention.
Figure 6:
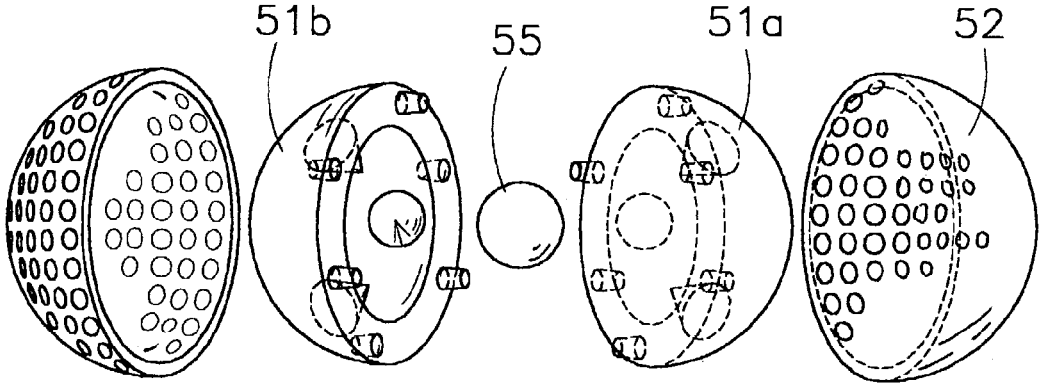
FIG. 6 shows a perspective view, in exploded form, of the golf ball from FIG. 5.

FIG. 3 diagrammatically depicts the situation in which the golf ball is being driven off a golf tee 10 by a golf club 11. The impact force which is exerted on the outer shell 2 by the golf club 11 deforms the outer shell 2, and consequently also the core body 1. Since the partition 5 is connected to the spherical body, and more particularly is accommodated in a manner sealed all the way around in a groove in the wall of the cavity 3, the deformation of the core body 1 subsequently ensures that the partition 5 is also deformed (FIG. 3) and is broken into small pieces (FIG. 4). The golf ball then returns to its original round shape. After the partition wall 5 has broken, the two compartments 6*a*, 6*b* are in open communication with one another and the two chemical components can mix. This mixing causes a chemical reaction during which light is emitted. The light emitted will shine through the transparent core body 1 and the transparent outer shell 2 and will illuminate the golf ball. Consequently, the golf ball according to the invention is particularly suitable for completing a round on a golf course which has been begun once dusk begins to fall. This is particularly advantageous since a round on a golf course lasts about four hours. Therefore, there is a high risk, particularly in the autumn or the winter, that dusk will fall during a round. By using the golf ball according to the invention, the ball remains visible and the round can be completed. The golf ball can also be used to play a round entirely in the dark, for example, during a night tournament.

The partition 5 is preferably of fragile design in such a way that a minimum external impact load of 300 N, and more particularly of 1000 N, is required in order to break the partition 5. This can be achieved by suitably selecting the material, the thickness and whether or not to form weakened sections in the partition. In addition to hitting the ball with a golf club 11, the minimum impact load required can also be achieved by throwing the golf ball forcibly against the hard ground or against a wall.

The thickness of the outer shell 2 is, for example, 1–3 mm. The diameter of the core body 1 is, for example, 36–41 mm. The diameter of the cavity 3 is, for example, 10–20 mm.

A possible method for producing the golf ball illustrated in FIGS. 1–4 comprises the following steps:

- the cavity part 3*a* in the first shell half 1*a* is filled with the first chemical component;
- the filled cavity part 3*a* is covered with the partition 5;
- the cavity part 3*b* in the second shell half 1*b* is filled with the other chemical component;
- the first shell half 1*a* together with partition 5 is turned over, positioned on the second shell half 1*b* and glued securely thereto.

It is thus possible, in a simple manner to implement rapid and efficient series production of golf balls according to the invention without there being any risk of making a mess with the chemical components.

In a variant, the shell halves 1*a*, 1*b* with the partition 5 arranged between them are glued together and the resultant compartments 6*a*, 6*b* are filled with the separate chemical components from the outside by means of injection.

The golf ball illustrated in FIGS. 5–9 is composed of two shell halves 51*a*, 51*b* of a flexible core body 51 and a relatively hard outer shell 52 which has been moulded around them and has dimples. The shell halves 51*a*, 51*b* together delimit a cavity 53 in which a plurality of inwardly projecting, conical support points 54 are provided. A spherical partition element 55 rests on the support points 54. The partition element 55 divides the cavity 53 into two compartments 56*a*, 56*b* (cf. FIG. 7) which are separate from one another. The compartment 56*a* is in this instance located inside the spherical partition element 55. The second compartment 56*b* is formed by the space which is left clear between the wall of the cavity 53, the conical support points 54 and the outside of the partition element 55.

Figure 7:
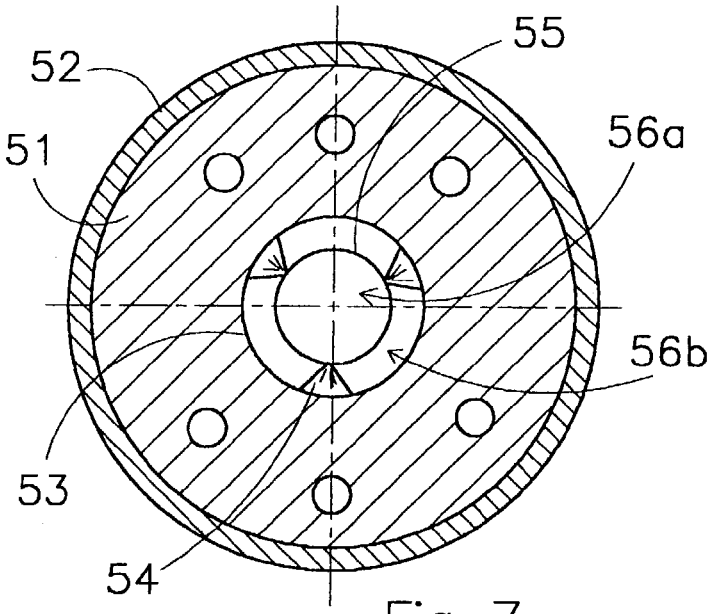
FIG. 7 shows a cross-sectional view of the golf ball from FIG. 6.
Figure 8:
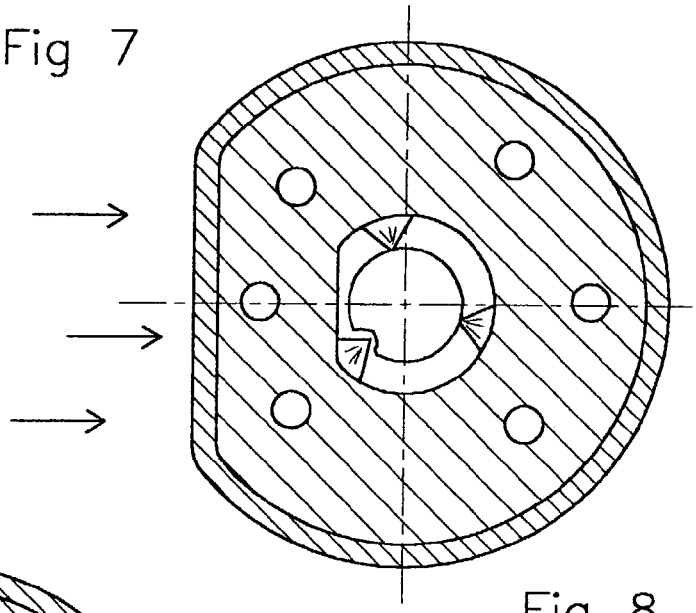
FIG. 8 shows a view in accordance with FIG. 7, with the golf ball in a first state of deformation.
Figure 9:
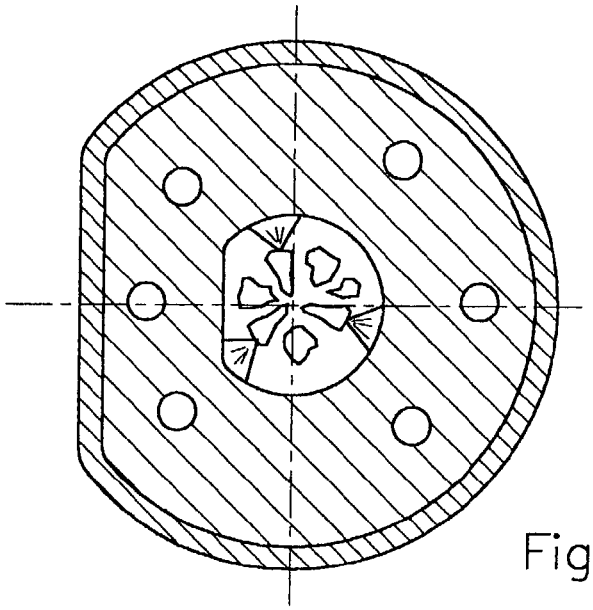
FIG. 9 shows a view in accordance with FIG. 7, with the golf ball in a second state of deformation.

FIGS. 7–9 illustrate the successive steps involved in activating the light-emitting means in the golf ball, and it can again be seen clearly that deformation of the outer shell 52 leads to deformation of the core body 51, with the result that the inwardly projecting support points 54 break open the partition element 55. After this, the two chemical components can mix with one another and emit light.

A possible method for producing this embodiment is for the spherical partition element 55 containing the first chemical component to be placed onto the support points 54 in the first shell half 51*a*. The first shell half 51*a* can then be covered and joined to the second shell half 51*b*, and the second compartment 56*b* can be filled with the second chemical component by injection.

In both embodiments shown, the wall of the cavity can be provided with a chemically resistant coating, so that the chemical compounds cannot affect the material of the flexible core body from the inside, which is advantageous. In a variant the core body itself is made from a chemically resistant material.

A coloured or reflective coating layer may be applied to the outer wall of the core body, having a diffusing effect, leading to an attractive scattering of light.

In addition to the arrangement shown in which the spherical body is split into a core body and an outer shell, it may also be made from a single transparent material.

Figure 12:
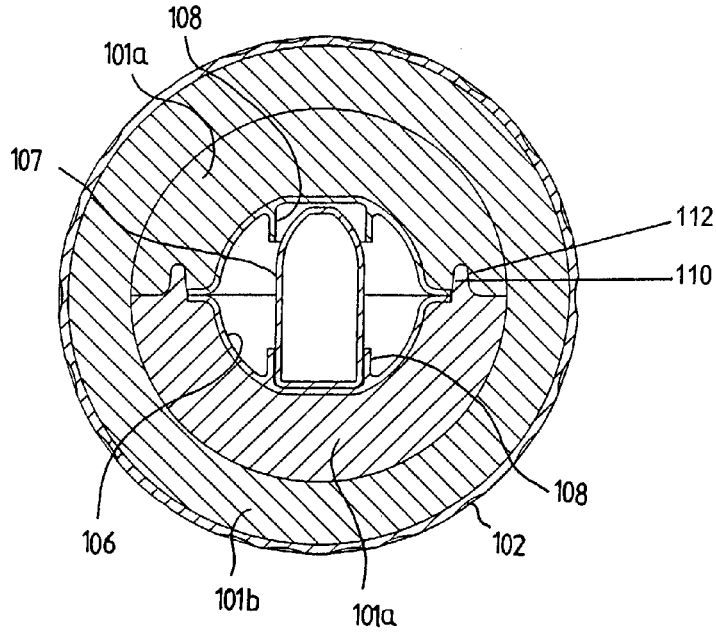
FIG. 12 shows a cross-sectional view of the golf ball from FIG. 10.
Figure 11:
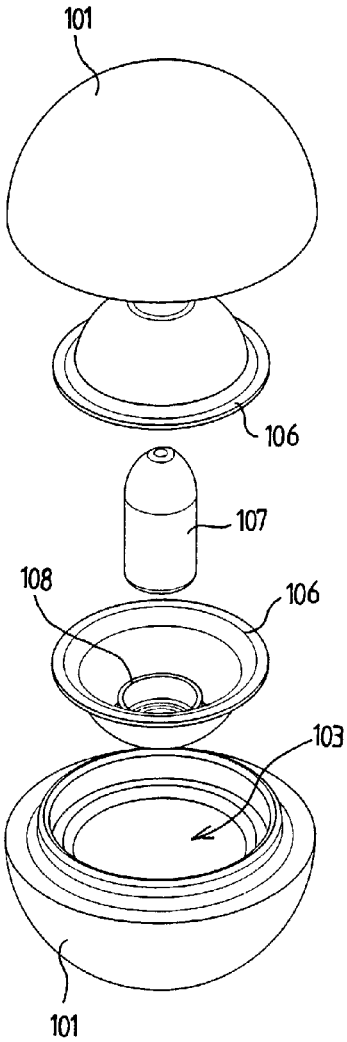
FIG. 11 shows a perspective view, in exploded form, of the golf ball from FIG. 10.
Figure 10:
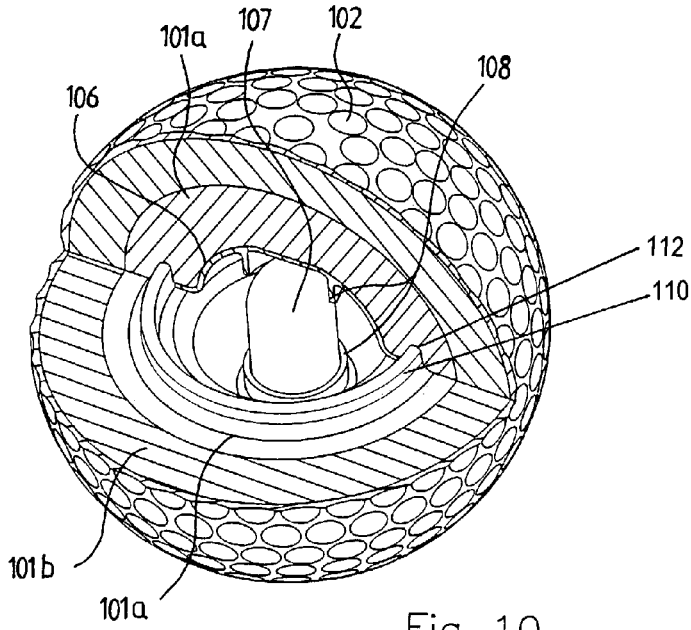
FIG. 10 shows a diagrammatic, perspective view of a third embodiment of a golf ball according to the invention.
Figure 13:
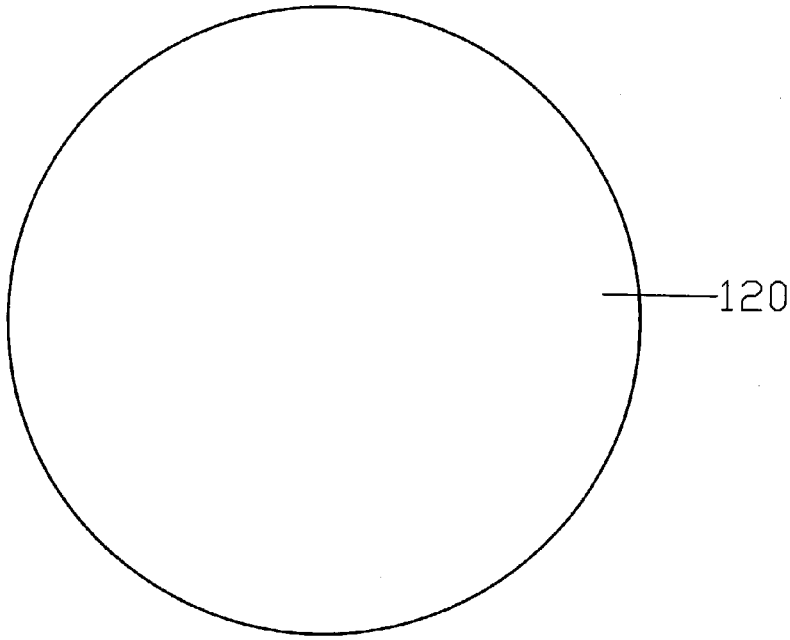
FIG. 13 shows a side view of a fourth embodiment of a golf ball according to the invention.
Figure 14:
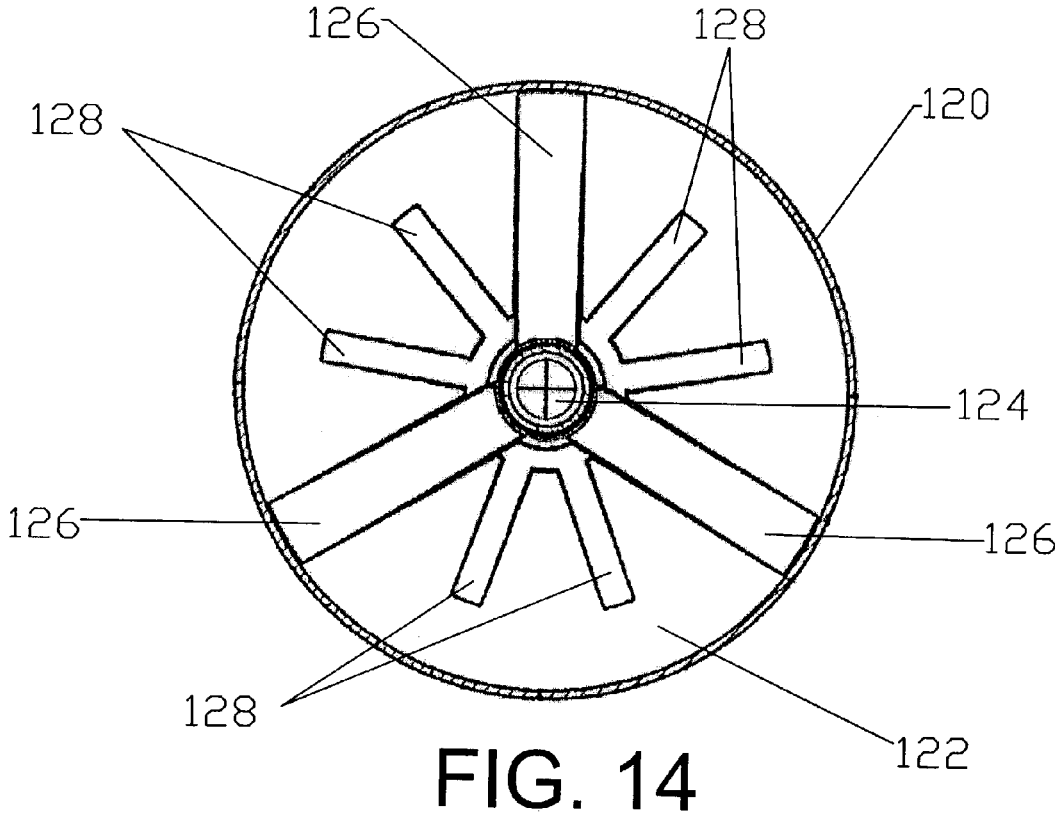
FIG. 14 shows a top view of one half of the shell of the golf ball from FIG. 13.
Figure 15:
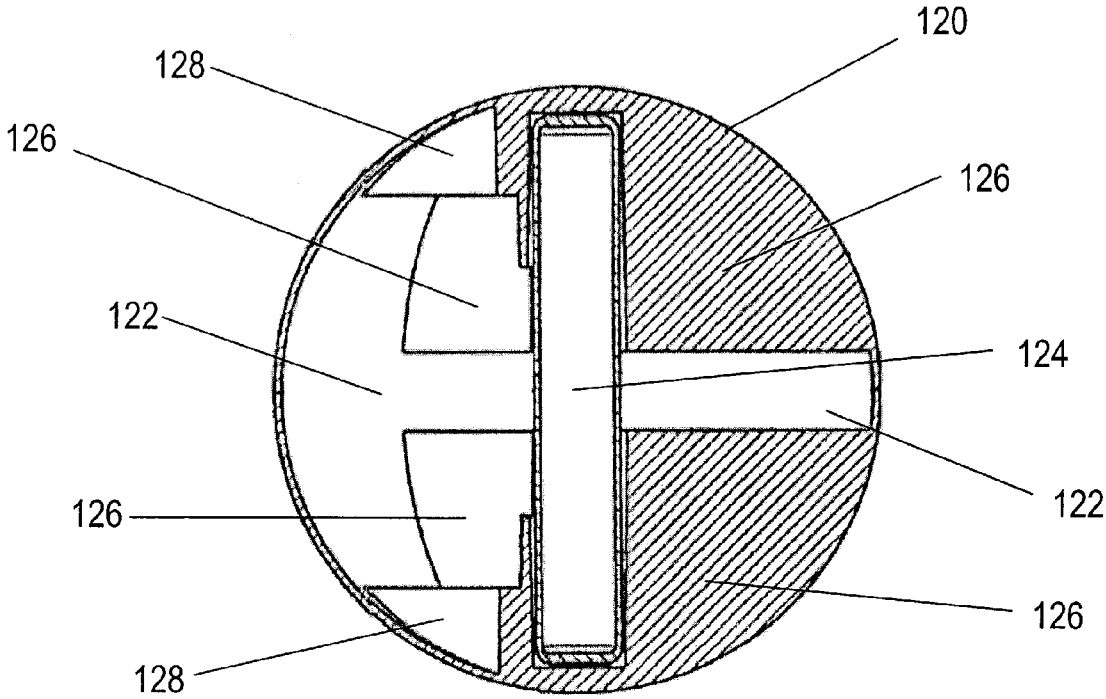
FIG. 15 shows a cut-a-way side view of the golf ball from FIG. 13.
Figure 16:
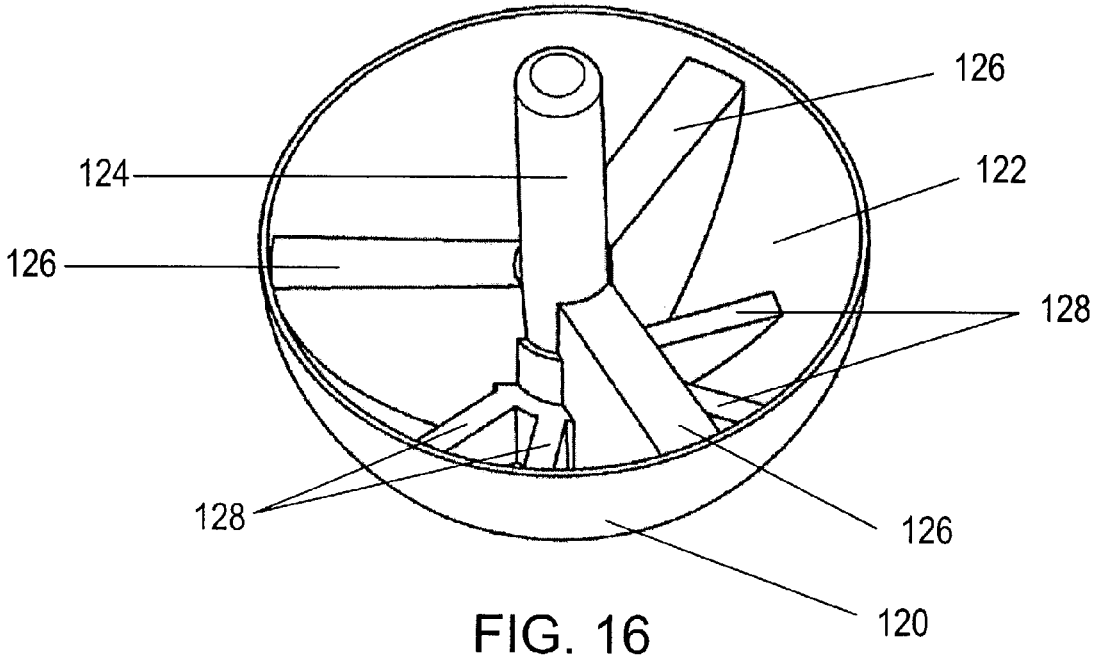
FIG. 16 shows a perspective view of one half of the shell of the golf ball from FIG. 13.

FIGS. 10–12 show a variant of a golf ball which is composed of a plurality of shell parts 101 and in which there is a cavity 103. Two hemispherical housing parts 106 are accommodated in the cavity 103, inside which housing parts there is a partition element which is a breakable capsule 107. In the assembled form, the housing parts 106 bear substantially against the walls of the cavity 103. The housing parts 106 comprise inwardly projecting support rings 108, between which ends of the capsule 107 are enclosed. A first chemiluminescent component is accommodated in the capsule 107, while a second chemiluminescent component is accommodated in the space between the capsule 107 and the housing parts 106. An impact load exerted on the outside of the golf ball will break the capsule 107, after which the chemiluminescent components can react with one another and emit light.

The advantages of this variant reside partially in the production process. The assembly of housing parts 106 and capsule 107 and chemiluminescent components already accommodated therein can easily be enclosed by the shell parts 101. In particular, inner shell parts 101*a* are positioned around the assembly of housing parts 106 and capsule 107, after which a further outer shell part 101*b* can be injection-moulded around the inner shell parts 101*a*, and a relatively hard outer shell 102 can be injection-moulded around the outer shell part 101*b*. Inner shell 101*a* consists of two halves, with one half having a projecting connecting ring 110 and the other half having a receiving recess ring 112 to receive the projecting connecting ring 110 of the other half. In particular, the outer shell part 101*b* can advantageously be moulded on without the assembly of housing parts 106 and capsule 107 being undesirably deformed.

FIGS. 13–16 show a variant of the golf ball which comprises a two-part spherical body made from a transparent material with a fully closed outer casing 120. The outer casing 120 can be integral to the two shell halves of the spherical body or can consist of a separate outer casing layer. Inside the spherical body a cavity 122 is provided inside which cavity 122 a capsule 124 made from a breakable material is placed. The capsule 124 is placed between several support ribs 126 which project inwards from the wall of the cavity 122. The support ribs 126 act to break the wall of the capsule 124 when an impact load is exerted on the outer casing 120. Between the support ribs 126 smaller strengthening ribs 128 can be provided. These strengthening ribs 128 help in preventing the support ribs 126 from bending sideways. The support ribs 126 and strengthening ribs 128 are of sufficient strength to provide support for the capsule 124. Both the support 126 and strengthening 128 ribs can contain apertures to allow fluid movement through the ribs in the cavity 122 section.

The capsule 124 is filled with one component of a chemiluminescent material, while at least part of the cavity 122 around the capsule 124 is filled with the other component of the chemiluminescent material. Thus the wall of the capsule 124 acts as a partition element initially separating the chemiluminescent components. The capsule 124 wall preferably is made from a brittle frangible material, but can also be made from another material provided with one or more weakened sections, for example one or more notches in a glass wall.

In addition to the embodiments shown, numerous variants are conceivable. For example, it is also possible for a closed capsule with two compartments which are separated from one another by a partition to be arranged in the cavity. A capsule of this nature can completely or partially fill the cavity. Preferably, the capsule is connected to the spherical body at one or more points. It is also possible for two capsules, each with their own compartment, to be arranged in the cavity. In this case, it is important that both capsules are made frangible and/or are connected to the spherical body in such a manner that they both break if an impact load is exerted on the outer casing of the golf ball.

In a variant which is not shown, breaker bodies, such as small steel balls, are accommodated in the first and/or second compartment, which balls are able to contribute to the action of breaking a partition element between the two compartments.

The partition element is preferably designed in such a manner that, when activated, it breaks into a large number of small pieces which will have little or no further effect on the in-flight properties of the golf ball.

Therefore, the invention provides a light-emitting golf ball which begins to emit light after an impact load has been exerted on the outside of the golf ball. The impact load preferably comprises a force which is exerted on the golf ball by a golf club when driving off the tee. While the golf ball is flying through the air, the two chemical components have the time and opportunity to mix with one another, and the golf ball will begin to emit light. By varying the wall thicknesses, types of material, and positioning, size and number of dimples on the outer shell, the golf ball can be designed in such a manner that it satisfies the requirements imposed on professional golf balls, such as the weight, size, hardness and resilience. After the light-emitting means have been exhausted, the golf ball can advantageously continue to be used for a long time by day. The chemical components enclosed in the core of the golf ball cannot leak out of the golf ball even after the light-emitting means have been exhausted.

The invention claimed is:

1. Light-emitting golf ball for use in the dark, comprising:

a spherical body made from a transparent material with an outer casing, the outer casing being fully closed; and a light-emitting means containing chemiluminescent components made from a chemiluminescent material, which components emit light once they have been mixed with one another;

wherein said spherical body is provided with a cavity in which there are compartments which are separated from one another by a partition element, one of said chemiluminescent components being accommodated in each compartment, and said partition element being of frangible design, in such a manner that an impact load exerted on said outer casing causes said partition element to break, after which said chemiluminescent components can mix with one another.

2. Light-emitting golf ball according to claim 1, in which the impact load required to break said partition element is greater than 1000 N.

3. Light-emitting golf ball according to claim 1, in which said partition element bears against at least one location of said spherical body, in such a manner that deformation of said spherical body caused by an impact load exerted on said outer casing breaks said partition element.

4. Light-emitting golf ball according to claim 3, in which said partition element is in the form of a disc and bears in a sealed manner against the wall of the cavity all the way around.

5. Light-emitting golf ball according of claim 1, in which said partition element surrounds at least one of said compartments.

6. Light-emitting golf ball according to claim 5, in which said partition element in said cavity is supported on support points which project inwards from the wall of said cavity, and wherein the support points act to break the partition element when the impact load is exerted on the outer casing.

7. Light emitting golf ball according to claim 1, in which said partition element is made from a brittle frangible material.

8. Light-emitting golf ball according to claim 1, in which said cavity is formed and positioned around the mass centre of the golf ball that the principle axes of inertia substantially remain the same.

9. Light-emitting golf ball according to claim 1, in which said partition element is provided with at least one weakened section.

10. Light-emitting golf ball according to claim 1, in which said spherical body comprises two shell halves which are connected to one another.

11. Light-emitting golf ball according to claim 10, in which said shell halves are symmetrical.

12. Light-emitting golf ball according to claim 1, in which the wall of said cavity is provided with a chemically resistant coating.

13. Light-emitting golf ball according to claim 1, in which the partition element is a capsule of frangible design,the inside of said capsule defining one of the compartments being filled with one of said chemiluminescent components, and the space between the outside of said capsule and said cavity defining the other compartment which is at least partially filled with said other chemiluminescent component.

14. Light-emitting golf ball according to claim 13, in which said capsule is positioned between support ribs projecting inwardly from the wall around said cavity.

15. Light-emitting golf ball according to claim 14, in which strengthening ribs projecting inwardly from the wall of the cavity are provided between said support ribs.

16. Light-emitting golf ball for use in the dark, comprising:

a spherical body comprising a fully closed outer casing, the outer casing being made of a transparent material;

a light-emitting means comprising chemiluminescent components made from a chemiluminescent material, which components emit light once they have been mixed with one another;

wherein the outer casing is provided with a cavity having a wall, wherein a capsule of frangible design is placed in said cavity, said capsule comprising two compartments separated by a partition element, each compartment being filled with one of said chemiluminescent components;

said partition element being of frangible design, wherein when an impact load exerted on said outer casing causes said partition element to break, after which said chemiluminescent components can mix with one another.

17. Light-emitting golf ball according to claim 16, in which said capsule is positioned between support ribs projecting inwardly from the wall around said cavity.

18. Light-emitting golf ball according to claim 16, in which strengthening ribs projecting inwardly from the wall of the cavity are provided between said support ribs.

19. An illuminated golf ball comprising:

a spherical body made from a transparent material;

the spherical body comprising a first shell half and a second shell half;

the first shell half having a plurality of inwardly projecting support ribs and a plurality of inwardly projecting strengthening ribs which define a first support cavity and a first recess cavity;

the second shell half having a plurality of inwardly projecting support ribs and a plurality of inwardly projecting strengthening ribs which define a second support cavity and a second recess cavity;

a capsule received by the first and second support cavities;

wherein the capsule contains a first chemiluminescent material and the first and second recess cavities contain a second chemiluminescent material; and wherein the capsule is of a frangible design such that when a golf club strikes the outer shell of the golf ball, the capsule breaks, after which said first and second chemiluminescent materials can mix with one another.

* * * * *